United States Patent [19]

Pope

[11] 4,267,874

[45] May 19, 1981

[54] EXPANDABLE BURGLAR PROOF WINDOW

[76] Inventor: Clarence Pope, P.O. Box 472, Glassboro, N.J. 08020

[21] Appl. No.: 16,526

[22] Filed: Mar. 1, 1979

[51] Int. Cl.[3] ..... E06B 3/32

[52] U.S. Cl. ..... 160/92

[58] Field of Search ..... 160/21, 89, 90, 91, 160/92, 223, 225, 226, 227, 228

[56] References Cited

U.S. PATENT DOCUMENTS

| | | | |
|---|---|---|---|
| 582,029 | 5/1897 | Tremmel | 160/92 |
| 1,496,378 | 6/1924 | Reichardt | 160/227 |
| 1,722,854 | 7/1929 | Mosbacher | 160/225 |
| 1,755,955 | 4/1930 | Hagopian | 160/228 |
| 2,112,634 | 3/1938 | Pilant | 160/92 |
| 2,179,541 | 11/1939 | Burke | 160/89 |
| 2,245,931 | 6/1941 | Meyer | 160/89 |

*Primary Examiner*—Peter M. Caun

*Attorney, Agent, or Firm*—Miller & Prestia

[57] ABSTRACT

An adjustable window guard and screen apparatus includes an adjustable framework of two sections slidably mated to each other. Also, at least one set of screen members, and a plurality of bar members are affixed to the framework and are expandable or contractable upon the adjustment of the framework. Louver members having two slidably mating sections are further included and are each in engagement with a bar member. At least one section of a bar member having a louver member mounted thereon, is itself rotatably mounted to the framework. The louver member is mounted to the bar member so that rotation of the rotatably mounted bar member section causes rotation of the louver member. Like the screen members and bar members, the louver members will expand or contract upon the adjustment of the framework. However, in the present invention the bar members while functioning as a mounting for the louver members, are also constructed of a strong material so as to function as a security guard for the prevention of intrusions into a dwelling.

15 Claims, 4 Drawing Figures

EXPANDABLE BURGLAR PROOF WINDOW

BACKGROUND OF THE INVENTION

The present invention relates to expandable and contractable window screens, and more particular such an apparatus wherein security guard means, for the prevention of burglaries, are further provided as part of the unit.

Individuals have always looked for means to protect one's dwelling from being broken into and burglarized. With the increasing rate of residential burglaries, this problem of protecting one's home, and personal belongings has been of paramount concern to us all. In the past, protective devices such as expandable window gratings have been disclosed in the prior art, such as in U.S. Pat. Nos. 2,755,525, 958,481, 3,224,048, 2,314,230, 1,734,415, 2,140,015 and re-issued U.S. Pat. No. Re. 17,911. However, if one also wished to leave a window open, for example to improve air circulation on a summer day, a device separate from those described above, would have to be used in order to allow for air circulation and yet keep out rain and troublesome insects and pests. Such a device was typically of the screening or louver type like those taught in U.S. Pat. Nos. 922,798, 930,743, 1,233,362, 1,722,854, 1,871,557, 2,314,230, 2,580,621 and 2,616,498.

Attempts have been made to fabricate an apparatus which includes louvers and yet provides some means of security protection, such as that disclosed in the U.S. Pat. No. 2,321,684 to Johnson. However, these attempts have not always met with success and have not always provided the security sought by the home or apartment dweller and have also been quite complicated. Also, the louver assembly of Johnson was not constructed so that it can readily fit almost any window opening, but was installed as a permanent fixture in the window. Thus, such a device would have to be custom made per the home owner's window specifications, and would be quite costly.

The object of the present invention is to provide in a single unit an apparatus which can readily be placed between the upper and lower sashes of a window frame allowing the circulation of air, and yet prevent the entrance of insects and rain into the dwelling and further provide security means for preventing break-ins through the window enclosing such an apparatus. These and other objects are provided by the adjustable window screen and guard apparatus of the present invention, while over coming many of those deficiencies found in prior art units. The present invention further accomplishes these objectives by providing an apparatus which is relatively inexpensive, easily to operate and readily transferable between window frames. The adjustable guard and screen apparatus of the present invention can be fabricated in various sizes and dimensions, so that one or more of the subject units can be utilized in an opened window frame.

SUMMARY OF THE INVENTION

An adjustable window guard and screen apparatus of the present invention includes an adjustable framework of two sections, wherein the sections are slidably mated with each other for extension or contraction of the framework in the longitudinal dimension thereof. The apparatus further includes at least one set of screen members, with each of the screen members being affixed to an opposite framework section and thereby capable of expansion or contraction upon adjustment of the framework. A plurality of adjustable bars are included, with each bar member having two slidably mating sections, each section being mounted to an opposite framework section. The adjustable bar members likewise can expand or contract in one dimension, with the adjustment of the framework. The bar members are also of a very strong material and function as security guards. One or more louver members each having two sections in adjacent slidable relationship to each other, are incorporated in the apparatus of the present invention. Each of the louver members is mounted to a bar member having its two sections rotatably mounted to the framework so that rotation of the bar member by a louver operating means causes rotation of the entire louver member. Thus, the adjustable bar member has a dual function as security guards as well as supports for the louver members.

BRIEF DESCRIPTION OF THE INVENTION

DETAILED DESCRIPTION OF THE INVENTION

Figure 1:
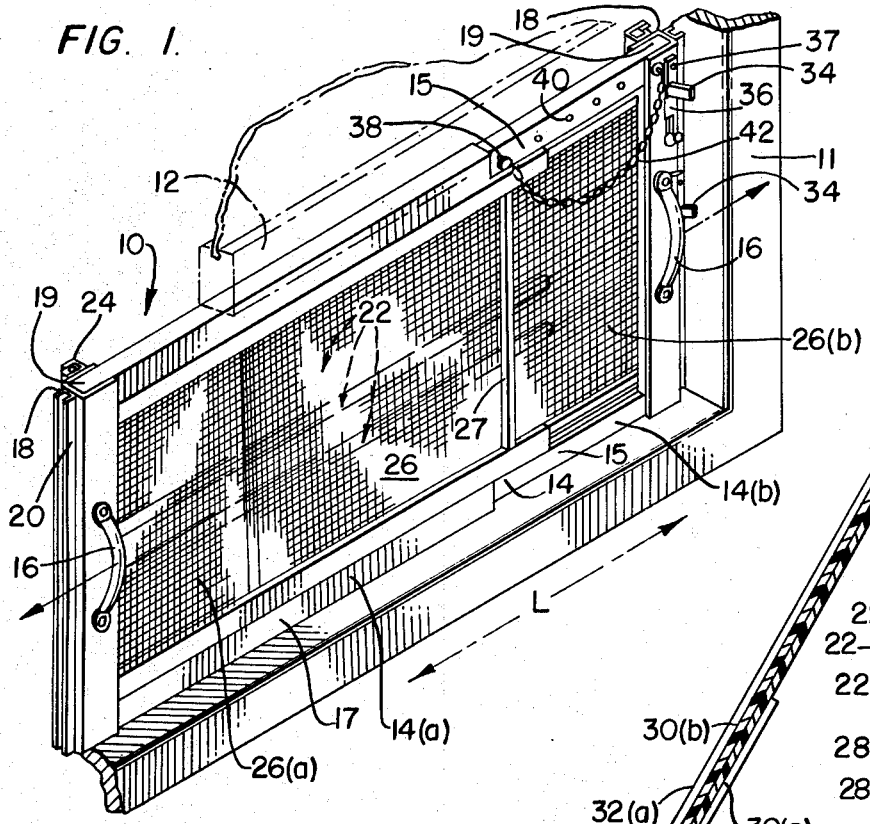
FIG. 1 is an elevational perspective view of the back of the adjustable window guard and screen apparatus of the present invention with a conventional window frame.

Referring to the drawings, the window guard and screen apparatus of the present invention is generally designated as 10. Window guard and screen apparatus 10 is adaptable for fitting into the lower or upper opening of a window frame 11 having sliding upper and lower sashes. One of the sashes designated as 12 is slid downwardly to contact the apparatus 10, closing off any opening in the window frame 11.

Apparatus 10 includes an adjustable framework 14, of a strong and rigid material, having two sections 14(*a*) and 14(*b*) which slidably mate in the longitudinal direction (L) of the apparatus 10. As shown in the drawings, the longitudinal elements 15 of framework section 14(*b*) are slidable in the longitudinal elements 17 of framework section 14(*a*). Framework 14 is generally hollow in construction and of any conventional cross-sectional area, however, a rectangular cross section is preferred since it is more readily applicable to fitting into a window frame opening.

Referring to FIG. 1, grasping means 16 are attached to the vertical elements 19 of the framework 14, so that by grasping the means 16 one can readily expand or contract in the longitudinal dimension (L) apparatus 10. Grasping means 16 are on the inside surface of apparatus 10 and are typically of a conventional form such as the handles as shown in FIG. 1 or they can be in the form of a knob.

Bracket means 18 are substantially U-shaped and fastened to the vertical elements 19 of the framework 14, substantially convering all of the vertical members. Extending from the bracket means 18 are guide means 20. Guide means 20 are also typically U-shaped and are provided for mating with the guide means typically found in a window frame having slidable sashes. Mating of the guide means 20 with the guide means of the window frame 11 provide for increased mounting stability of apparatus 10.

Figure 4:
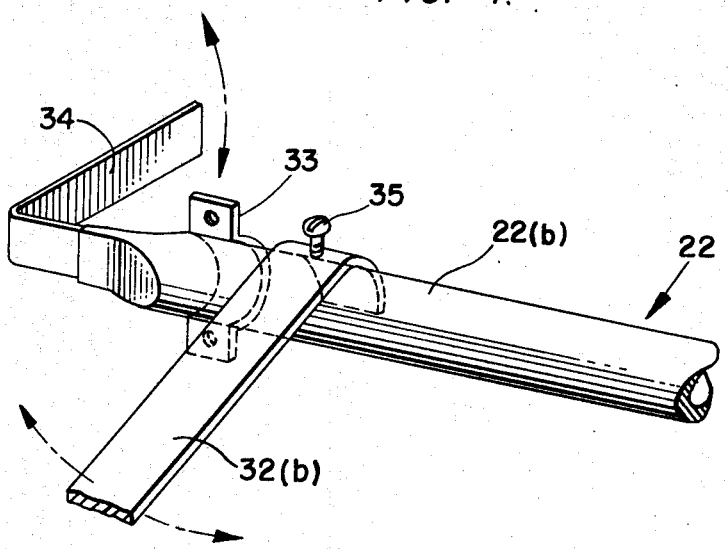
FIG. 4 is an exploded view of a bar member of the present invention in engagement with a louver operator.

A plurality of adjustable bar members 22, extend longitudinally across the apparatus 10. Each bar member 22 has two slidably mating sections, with one section designated 22(*b*) and slidable in the other section designated 22(*a*). The ends of those bar member sections having no louver members attached (subsequently discussed), are securely and rigidly fastened in a permanent manner, such as by welding or bolting, to the vertical members 19 of the framework 14. Those bar members 22 to which a louver member is attached have the ends of each section rotatably mounted to the framework, as by the U-bracket 33 in FIG. 4 or by a conventional journal arrangement.

Upon longitudinal adjustment of the work frame 14, the bar members 22 expand or contract along the longitudinal direction of apparatus 10. Typically the bar members 22 are constructed of elongated, hollow metal rods.

Cover members 24 extend along the vertical members 19 concealing either the ends of the bar members 22 which are mounted to the framework 14 or to conceal the means used to fasten the bar members, such as bolts. Cover members 14 are permanently secured to the framework 14 in a conventional permanent manner, thereby providing additional mounting security of the bar members 22 to the apparatus 10. Cover members 24 further adds rigidity to the apparatus 10.

A first and second set of screen members 26 and 28 are adapted for expansion or contraction with adjustment of framework 14. Each screen member of both sets includes a frame 27 on which the screening is affixed. Each screen member of a set is fixed to an opposite framework section, but is in slidable relationship with the other screen member in the set. Thus, first set of screen members 26 includes a member 26(*a*) affixed to framework section 14(*a*) and a second member 26(*b*) is affixed to framework section 14(*b*). Likewise, the second set of screen members 28, include a first member 28(*a*) affixed to the first framework section 14(*a*) with a second screen member 28(*b*) affixed to the second framework section 14(*b*).

Figure 3:
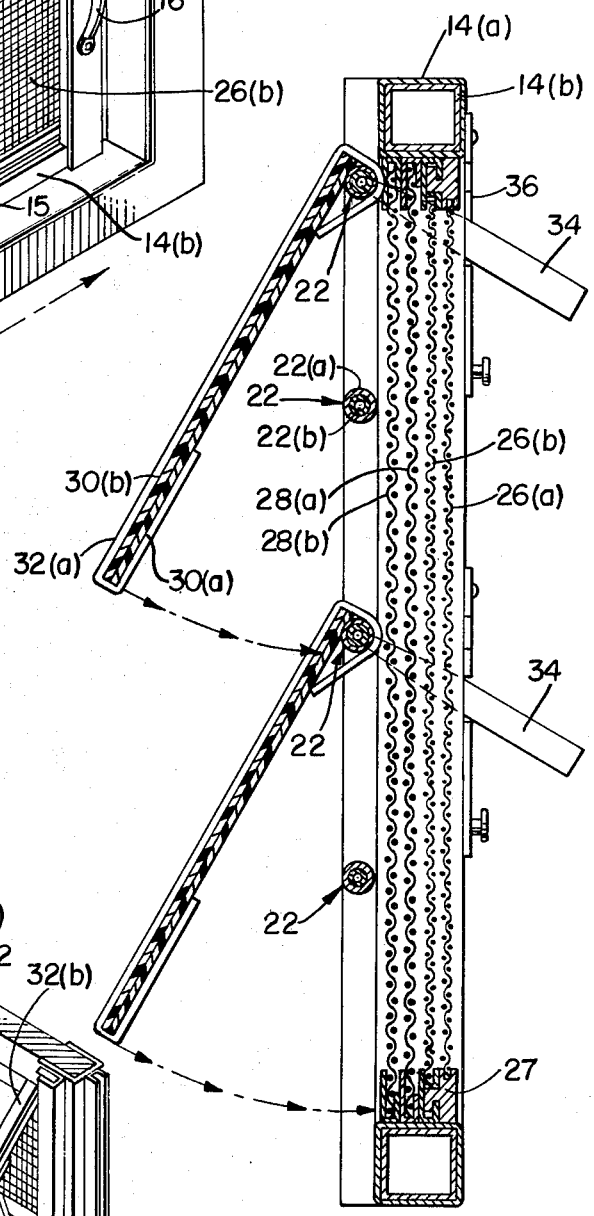
FIG. 3 is a cross-sectional view of the present invention taken along line 3—3 of FIG. 2.

Each screen member is in slidable relationship with its companion screen member by conventional means. For the purpose of describing the present invention, the first set of screen members 26 are depicted in slidable relationship by means of a conventional tongue and groove arrangement in the frames 27, reference FIG. 3. The second set of screen members 28, as shown in FIG. 3, are affixed to the framework 14 and adapted such that the screen frames 27 are juxtaposed to each other and slidable over each other. It is anticipated by the present invention that either of these manners of attaining sliding relationship can be used with either or both of the sets of screen members, while other conventional means of providing a sliding relationship are also applicable.

First and second sets of screen members 26 and 28 are of a different mesh size. One set of screen members is of a fine mesh size so as to prevent the entrance of insects or small objects, while the other set of screen members is of a larger mesh size preventing the entrance of large hard objects, such as rocks or stones. For the purpose of describing the present invention, it is assumed that the first set of screen members 26 are of a fine mesh while the second set of screen members 28 are of the larger mesh, i.e. one-quarter by one-quarter inch hardware cloth.

While the embodiment of the present invention has been described as having two sets of screen members 26 and 28, it is anticipated by the present invention that both sets of screen members are not needed for the successful operation of the present invention. However, if only one set of screen members is to be utilized, then it is preferable that it be of the finer mesh type.

Adjustable window guard and screen apparatus 10 further includes one or more louver members 30 which are in the form of two sections in slidable relationship and designated 30(*a*) and 30(*b*). The louver sections 30(*a*) and 30(*b*) are held in slidably adjacent relationship by strap members 32(*a*), which at least partially surround the louver sections and further partially encircles a bar member 22 as one of the means for affixing the louver member 30 thereto. Furthermore, strap members 32(*b*) at the ends of each louver member section, tightly encircles the individual louver section with a section of bar member 22 and a screw 35 is threaded through the strap member 32(*b*), the louver section and into the bar member section (reference FIG. 4). Thus, rotation of bar member 22 will cause further rotation of the louver member 30. Typically the louver members 30(*a*) and 30(*b*) are of a light transparent material, such as a clear plastic, and the strap members 32 are of flat strips of a flexible metal, such as aluminum.

When the plurality of louver members 30 are in the closed position, neighboring louver members should be in over-lapping relationship thereby preventing the entrance of the elements, such as rain, through the apparatus 10.

While the embodiment of the present invention as shown in FIGS. 1 to 4 depicts a plurality of louver members, it is anticipated that the present invention can be constructed with only one louver member 30 substantially covering the entire window guard and screen apparatus 10 of the present invention. Furthermore, while in describing the present invention, both bar member sections to which a louver member 30 is mounted, has been described as being rotatably mounted to the framework 14. However, it is further anticipated by the present invention that any one section of a bar member 22 need be rotatably mounted with respect to the framework 14, while the other section is rigidly mounted thereto. Thus, the louver member 30 would be rigidly mounted to the rotatable bar member section, as described above, and rotatable to the rigidly mounted bar member section by appropriate adjustment of the strap members 32(*a*) and 32(*b*) by other conventional means.

Each of the louver members 30 is rotated along with its supporting bar member 22 by louver operation means 34, which is typically an L-shaped handle or elongated member extending through the framework 14 and affixed at one end to a rotatable bar member section. The opposite end of the handle 34 extends out from the inside surface of apparatus 10 and by a generally upward and downward movement of the handle 34 to various slots in a handle keeper latch 36, the individual louver members 30 fully open or close, or are placed in some intermediate position. Latch 36 may itself be rotatably mounted at an end 37 to the framework 14 and thus rotatably engage and disengage handle 34.

In the operation of the present invention, after one has adjusted the handles 16 so that the window guard and screen apparatus 10 fits longitudinally across the entire window frame opening, the apparatus 10 is maintained in such position by means of a pin 38 which can be placed in any one of a plurality of holes 40 extending along a longitudinal member 15 of the framework section 14(*b*). Once the apparatus 10 has been properly seated into the opening of the window frame 11, the pin 38 is placed into the hole 40 in closest relationship to the longitudinal member 17 of the framework section 14(*a*). Thus, if someone attempts to remove the apparatus 10 from the window frame 11, by contraction of the apparatus 10, pin 38 would contact framework section 14(*a*) and prevent any further contraction of the window apparatus. Furthermore, a keeper chain 42 is attached at one end to pin 38 and at the other end to the framework 14, so that the pin 38 will always be readily available.

Figure 2:
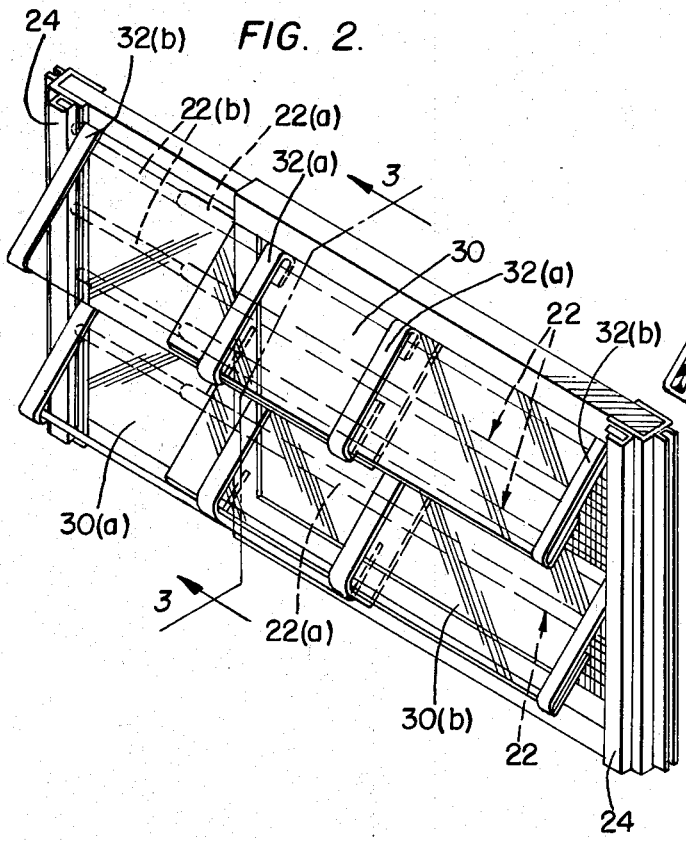
FIG. 2 is a perspective elevational view of the front of the apparatus of FIG. 1.

It is also possible to utilize two or more of the window guards of FIGS. 1 or 2, one on top of the other, in a casement or other window, to occupy the entire lower half of the window opening.

Therefore, the adjustable window guard and screen apparatus of the present invention, provides security from burglaries, it further serves the purpose of preventing the entrance of the elements, insects, and hard dangerous objects through an opened window and into the dwelling.

Although this invention has been described with reference to specific embodiments thereof, it will be appreciated that various other modifications may be made, including the substitution of equivalent components in substitution for those shown and described. Further, the invention comprehends the use of certain features independently of other features, reversals of parts and substitution of equivalent elements, all of which modifications may be made without departing from the spirit and scope of the invention as defined in the appended claims.

I claim:

1. An adjustable window guard and screen apparatus comprising:

an adjustable framework of two sections, said sections being slidably mated for expansion and contraction of said framework in the longitudinal dimension thereof;

a set of screen members, each of said screen members being affixed to an opposite framework section and in slidable relationship with each other for expansion or contraction thereof upon adjustment of same framework, a plurality of adjustable bar members, each bar member having two slidably mating sections and each bar member section mounted to an opposite framework section, said bar members constructed for expansion and contraction with adjustment of said framework and further constructed to function as security guards, one or more louver members, each of said louver members being in the form of two sections in slidably adjacent relationship to each other for slidable expansion and contraction with adjustment of said framework, each louver member mounted to a bar member, said bar member sections to which a louver member is mounted being rotatably mounted to said framework, said louver member affixed to said bar member so that said louver member rotates upon rotation of said bar member; and louver operating means for rotating said bar member and said louver member mounted thereon.

2. The adjustable window guard and screen apparatus in accordance with claim 1, further comprising strap members at least partially encircling said louver member sections and said bar member, for maintaining said louver sections in slidably adjacent relationship and for mounting said louver member to said bar member.

3. The adjustable window guard and screen apparatus in accordance with claim 2, wherein some strap members tightly surround said individual louver section and fastening means through said strap member, and louver member and said bar member further affix said louver member to said bar member.

4. The adjustable window guard and screen apparatus in accordance with claim 2, wherein said strap members are of flat strips of a flexible metal.

5. The adjustable window guard and screen apparatus in accordance with claim 1, wherein said bar members without a louver member mounted thereon have both bar member sections rigidly secured to the framework at their ends.

6. The adjustable window guard and screen apparatus in accordance with claim 1, wherein said means for individual rotation of one bar member and said louver member mounted thereon comprises a louver operator extending through said framework, one end of said louver operator affixed to one section of said bar member, the opposite end of said louver operator extending from said framework, and adapted to operate as a handle, said louver operator constructed so that the generally up and down movement of same causes said louver member to rotate with said bar member.

7. The adjustable window guard and screen apparatus in accordance with claim 6, wherein said louver operator is generally L-shaped.

8. The adjustable window guard and screen apparatus in accordance with claim 1, wherein a louver member is mounted on each of said bar members.

9. The adjustble window guard and screen apparatus in accordance with claim 1 further comprising a second set of screen members, each screen member of said second set being affixed to an opposite framework section and being in slidable relationship with each other for expansion and contraction thereof upon adjustment of said framework, said second set of screen members being in substantially parallel orientation with said other set of screen members.

10. The adjustable window guard and screen apparatus in accordance with claim 8, wherein one set of said screen members is of a finer mesh than the other set of screen members.

11. The adjustable window guard and screen apparatus in accordance with claim 8, wherein the screen members of at least one of said sets slidably mate with each other.

12. The adjustable window guard and screen apparatus in accordance with claim 1, wherein said bar members are elongated rods, with one section of each bar member slidable into its mating section.

13. The adjustable window guard and screen apparatus in accordance with claim 1, wherein said louvers are of a light transparent material.

14. An adjustable window guard and screen apparatus comprising:

an adjustable framework of two sections, said sections being slidably mated for expansion and contraction of said framework in the longitudinal dimension thereof;

a set of screen members, each of said screen members being affixed to an opposite framework section and in slidable relationship with each other for expansion and contraction thereof upon adjustment of same framework, one or more louver members, each of said louver members being in the form of two sections in slidably adjacent relationship to each other for slidable expansion and contraction with adjustment of said framework, each louver member mounted to a bar member, at least one section of said bar member to which a louver member is mounted being rotatably mounted to said workframe, said louver member affixed to said one bar member section so that said louver member rotates upon rotation of said one bar member section; and louver operating means for rotating said one bar member section and said louver member mounted thereon.

15. The adjustable window guard and screen apparatus in accordance with claim 14, wherein said bar member section mating with said rotatably mounted bar member section, being rigidly secured at an end to said framework.

* * * * *